US009354578B2

(12) United States Patent
Yeh

(10) Patent No.: US 9,354,578 B2
(45) Date of Patent: May 31, 2016

(54) SYSTEMS AND METHODS FOR FORECASTING SUPPLY OR SERVICE CONSUMPTION FOR A PRINTING DEVICE

(75) Inventor: Andrew S. Yeh, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 243 days.

(21) Appl. No.: 13/417,724

(22) Filed: Mar. 12, 2012

(65) Prior Publication Data

US 2013/0236198 A1 Sep. 12, 2013

(51) Int. Cl.
*G03G 15/00* (2006.01)
*G03G 11/00* (2006.01)

(52) U.S. Cl.
CPC ..... *G03G 15/556* (2013.01)

(58) Field of Classification Search
USPC ..... 399/24–27; 700/291
See application file for complete search history.

(56) References Cited

U.S. PATENT DOCUMENTS 7,251,589 B1 * 7/2007 Crowe ..... G06F 17/08 702/181
7,797,189 B2 9/2010 Rai et al.
7,848,946 B2 * 12/2010 Acharya ..... G06Q 30/02 705/7.31
2002/0143669 A1 * 10/2002 Scheer ..... G06Q 10/087 705/28
2002/0198794 A1 * 12/2002 Williams ..... G06Q 10/087 705/28
2003/0105661 A1 * 6/2003 Matsuzaki ..... G06Q 10/06 705/7.25
2003/0200134 A1 * 10/2003 Leonard ..... G06Q 30/0202 705/7.31
2008/0120166 A1 * 5/2008 Fernandez ..... G06Q 30/02 702/179
2008/0255760 A1 * 10/2008 Rojicek ..... G06Q 10/04 702/3
2009/0125288 A1 * 5/2009 Main ..... E21B 49/00 703/10
2010/0030617 A1 2/2010 Handley
2010/0070390 A1 * 3/2010 Komejan ..... G06Q 10/0875 705/29
2010/0082458 A1 * 4/2010 Godlewski ..... G06Q 30/0635 705/28
2010/0268572 A1 * 10/2010 Handley ..... G06Q 10/087 705/28
2011/0196718 A1 8/2011 Kulkarni et al.

FOREIGN PATENT DOCUMENTS

EP 1918786 A2 * 5/2008 ..... G03G 15/00
NL EP 1918786 A2 * 5/2008 ..... G03G 15/6508

OTHER PUBLICATIONS

"Dynamic Linear Models with R" Petris, 2009, ISBN: 978-0-387-77237-0.*
"Dynamic Linear Models with R" Petris G, 2009, ISBN 978-0-387-77237-0.*

* cited by examiner

*Primary Examiner* — Clayton E Laballe
*Assistant Examiner* — Victor Verbitsky
(74) *Attorney, Agent, or Firm* — Fox Rothschild LLP

(57) ABSTRACT

Methods and systems of forecasting consumption of a consumable for a machine are disclosed. A computing device receives consumption time series data for a consumable for a plurality of machines. The consumption time series data for each machine includes an amount of the consumable consumed by the machine during each of multiple time periods. For at least one of the plurality of machines, the computing device determines a model consumption forecast for the machine for each of multiple dynamic linear models based on the consumption time series data for the consumable for the machine and the dynamic linear model. The computing device further determines, for at least one of the machines, a final consumption forecast based on the model consumption forecasts. An amount of the consumable is provided for the at least one machine based on the final consumption forecast.

23 Claims, 3 Drawing Sheets

SYSTEMS AND METHODS FOR FORECASTING SUPPLY OR SERVICE CONSUMPTION FOR A PRINTING DEVICE

BACKGROUND

Time series data is recorded for a number of business processes in order to identify past performance metrics and to predict future performance. Such time series data has been used to model various machines, such as printing devices, to determine the rate at which such machines use consumables. However, inaccurate forecasting of time series data reduces operational efficiency and can cause unnecessary expense due to excess or shortage of inventory, non-optimal resource usage, premium freight or labor charges, or the like. One challenge is finding a modeling framework that most accurately describes a wide variety of observed behavior among customers or machines and for different time periods for a particular customer or machine.

SUMMARY

This disclosure is not limited to the particular systems, devices and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention. As used in this document, the term "comprising" means "including, but not limited to."

In an embodiment, a system for forecasting consumption of a consumable for a machine may include a processor and a processor-readable non-transitory storage medium in communication with the processor. The processor-readable storage medium may contain one or more programming instructions that, when executed, cause the processor to receive consumption time series data for a consumable for a plurality of machines, where the consumption time series data for each machine comprises, for each of a plurality of time periods, an amount of the consumable consumed by the machine during the time period, and, for at least one machine of the plurality of machines, determine a model consumption forecast for each of a plurality of dynamic linear models, based on the consumption time series data for the consumable for the machine and the dynamic linear model, determine a final consumption forecast based on the plurality of model consumption forecasts, and determine an amount of the consumable for the machine based on the final consumption forecast.

In an embodiment, a method of forecasting consumption of a consumable for a machine may include receiving, by a computing device, consumption time series data for a consumable for a plurality of machines, where the consumption time series data for each machine comprises, for each of a plurality of time periods, an amount of the consumable consumed by the machine during the time period; and, for at least one machine of the plurality of machines, determining, by the computing device for each of a plurality of dynamic linear models, a model consumption forecast for the machine based on the consumption time series data for the consumable for the machine and the dynamic linear model, determining, by the computing device, a final consumption forecast based on the plurality of model consumption forecasts, and providing an amount of the consumable for the machine based on the final consumption forecast.

DETAILED DESCRIPTION

The following terms shall have, for the purposes of this application, the respective meanings set forth below.

As used herein, the terms "sum," "product" and similar mathematical terms are construed broadly to include any method or algorithm in which a single datum is derived or calculated from a plurality of input data.

A "computing device" refers to a computer, a processor and/or any other component, device or system that performs one or more operations according to one or more programming instructions. An illustrative computing device is described in reference to FIG. 3.

A "consumable" refers to any product or service that is used in the performance of an operation. For example, an amount of paper used by a printing device may be determined by a print volume. Alternately, an amount of toner used by a printing device may be estimated by the print volume or measured by a decrease in the amount of available toner. Similarly, an amount of work performed by an individual may be used to determine the amount of a service that is performed.

A "machine" refers to a device used to perform a task. In a print production environment, a machine may include, without limitation, a printing device.

A "printing device" refers to a machine capable of performing one or more print-related functions. For example, a print device may include a printer, a scanner, a copy machine, a multifunction device, a collator, a binder, a cutter or other similar equipment. A "multifunction device" is a device that is capable of performing two or more distinct functions. For example, a multifunction device may have print and scan capabilities.

A "service" refers to one or more operations. Illustrative services may include, without limitation, printing, copying, binding, delivering materials, procurement, production, and the like.

A "service provider" refers to an entity that performs one or more services for a user. A service provider may generally perform, for example and without limitation, print services, copy services, construction services, delivery services, and/or any other types of services.

The present disclosure teaches methods and systems for forecasting the consumption of a consumable for a large disparate population of customers and/or machines. Historical information (i.e., consumption time series data) may be collected for each customer and/or machine. The historical information may be ordered as a time series with discrete data points identified for particular time periods.

Figure 1:
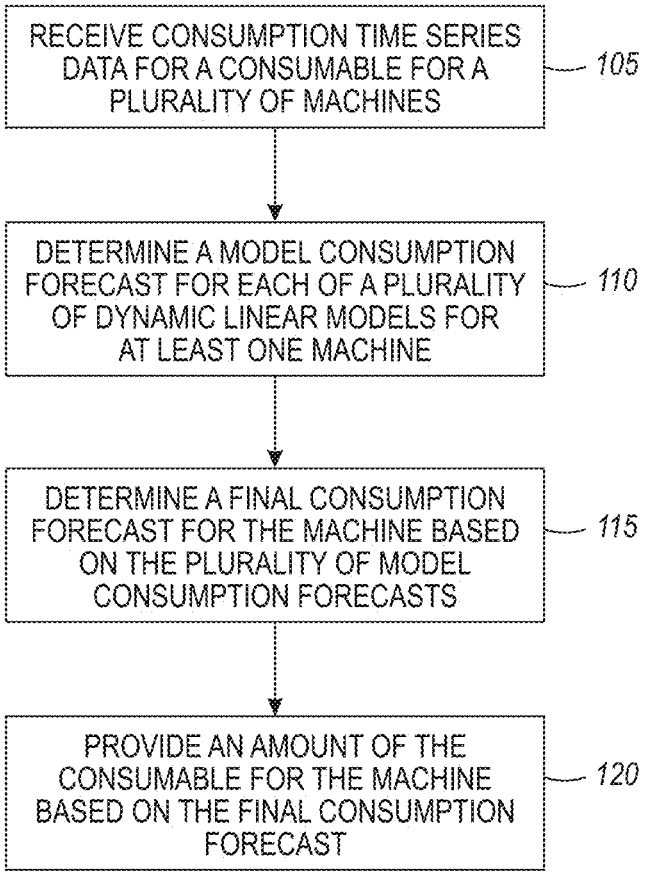
FIG. 1 depicts a flow diagram of an illustrative method of forecasting consumption of a consumable for a machine according to an embodiment.

FIG. 1 depicts a flow diagram of an illustrative method of forecasting consumption of a consumable for a machine according to an embodiment. As depicted in FIG. 1, a computing device may receive 105 consumption time series data for a consumable for a plurality of machines. The consumption time series data for each machine may include an amount of the consumable consumed by the machine in each of a plurality of time periods. For example, and without limitation, the consumption time series data may include an amount of a consumable consumed by the machine in a day, a week, a month, a year or any other time period. The amount of a consumable that is consumed by the machine may be determined based on measuring the remaining consumable in the machine, by estimating the use of the consumable based on the type of operation being performed or the like.

For example, the amount of toner used to print a page may be estimated based on the type of print operation being performed and the machine on which it is performed based on historical data. In a print embodiment, the consumption time series data that is received 105 may include print volume usage based on one or more of print impression meter reads and toner usage. Print impression meter reads may refer to reading a counter associated with a printing device that keeps track of the number of print impressions made by the printing device. Toner usage may refer to determining the actual amount of toner used by a printing device (based on, for example, an amount of toner used or remaining in a toner cartridge or other receptacle). In an embodiment, consumption time series data may be recorded for each type of toner present in a printing device. For example, a color printing device may include 3, 4 or more toner receptacles, for which consumption time series data may be separately stored.

In an embodiment, consumption time series data that is received 105 may include consumption time series data for a consumable for a plurality of machines having a similar machine type. For example, consumption time series data may be received 105 for printing devices of the same make and model. Alternately, consumption time series data may be received 105 for printing devices in the same class of printers, such as desktop printing devices, high-volume printing devices, or the like. Reception 105 of consumption time series data for similar classifications and groupings of machines may also be performed within the scope of this disclosure.

The computing device may determine 110, for each of a plurality of dynamic linear models, a model consumption forecast for at least one machine of the plurality of machines based on the consumption time series data for the consumable for the machine and the dynamic linear model. In other words, each model consumption forecast may correspond to a dynamic linear model and a machine, and a plurality of model consumption forecasts may be determined 110 for each machine. Each dynamic linear model may comprise a Bayesian model having an identified set of parameters. The parameters for each dynamic linear model may correspond to a common set of features amongst the dynamic linear models. However, each model may have different values for the set of parameters. Each state space model may have operational parameters that vary in time based on customer behavior. External perturbations to the system may be included in a model to improve forecasting. In an embodiment, information may be shared across customers in similar subpopulations in order to increase forecasting accuracy.

In an embodiment, one or more of the dynamic linear models used to make the determination of the model consumption forecast may be additive models. Additive models may add together month-to-month (or other period-based) predictions and unusual variations, such as seasonal components to the model. For example, if an increase in production of approximately 1000 units occurs every December, 1000 units may be added to a month-to-month forecast for December based on the seasonal variation.

In an embodiment, one or more of the dynamic linear models used to make the determination of the model consumption forecast may be multiplicative models. Multiplicative models may multiply a month-to-month (or other period-based) prediction by a factor associated with an unusual variation, such as a seasonal component. For example, if an increase in production of approximately 10% occurs in December, the month-to-month prediction for December may be multiplied by approximately 1.10 in order to account for the seasonal variation.

In an embodiment, dynamic linear models having a large range of seasonality (unusual variation) to trend (period-based) weighting may be used to accommodate machines operated by customers that are largely seasonal, customers that are largely trending, and customers that fall somewhere in between. In an embodiment, the weighting factors for the dynamic linear models may range from about 1E−06 to about 1E+05 (i.e., about 0.000001 to about 100,000). Dynamic linear models having different weighting factors may also be used within the scope of this disclosure.

In an embodiment, the dynamic linear models may have a large range in signal to noise ratio used to separate the underlying signal and the natural variability of the customer behavior. In an embodiment, the signal to noise ratio for the dynamic models may range from about 2E−01 to 1.1E+05 (i.e., about 0.2 to about 110,000). Dynamic linear models having alternate signal-to-noise ratios may also be used within the scope of this disclosure.

In an embodiment, a machine's periodic consumable level (such as a print volume) can be considered an observable time series $Y_t$, where the machine data is specified as impressions (meter reds) or consumable usage (percentage of a toner bottle used or remaining). A Bayesian state space model may be used with the assumption that there is an unobservable state time series $\theta_t$ and that $Y_t$ is an imprecise measurement of $\theta_t$. Knowledge may be measured as a probability, and forecasts may be conditional distributions based on prior knowledge. As such, a state space model may include the following:

State time series $\theta_t \in \Re^p$: t=0, 1, 2, . . . , where $\theta_t$ is a Markov chain:

$$\pi(\theta_t|\theta_0,\theta_1,\ldots,\theta_{t-1})=\pi(\theta_t|\theta_{t-1})$$

Observable time series $Y_t \in \Re^m$: t=1,2,3, . . . , where $Y_t$ are independent and depend on $\theta_t$ only.

Dynamic linear models (or Gaussian linear state space models) may be applied to the machine data. $Y_t$ and $\theta_t$ may be specified by their means and variances, and the transformations from $\theta_t \rightarrow Y_t$ and $\theta_{t-1} \rightarrow \theta_t$ may be linear. In an embodiment, different dynamic linear models may combine the trend (periodic or period-based) and seasonal (intermittent or unusual) components with varying relative weights. In an embodiment, each dynamic linear model may combine the trend and seasonal components in one of an additive and a multiplicative mode. In an embodiment, the dynamic linear models may have varying signal to noise ratios. In an embodiment, the dynamic linear models have initial conditions dependent on other machines in the same product family. Based on the above, the following equations result:

Observation Equation: $Y_t=F_t\theta_t+v_t$ with $v_t \approx N_m(0,V_t)$

System Equation: $\theta_t=G_t\theta_{t-1}+w_t$, with $w \approx N_p(0,W_t)$

Prior Distribution: $\theta_0 \approx N_p(m_0,C_0)$, where $Y_t$ represents the observations at time t, $\theta_t$ represents the state vectors at time t, $F_t$ is a known matrix transforming state into observation, $G_t$ is a known matrix defining the time evolution of the state vector, $v_t$ and $w_t$ are independent Gaussian random vectors. For a model in which each time period is a month, 12 time periods may be considered when determining an estimation for a subsequent time period. In such a case, $F_t$ and $G_t$ may be the following:

$$F_t = \begin{bmatrix} 1 \\ 0 \\ 0 \\ 0 \\ 0 \\ 0 \\ 0 \\ 0 \\ 0 \\ 0 \\ 0 \\ 1 \end{bmatrix},$$

and $$G_t = \begin{bmatrix} -1 & -1 & -1 & -1 & -1 & -1 & -1 & -1 & -1 & -1 & -1 & 0 \\ 1 & 0 & 0 & 0 & 0 & 0 & 0 & 0 & 0 & 0 & 0 & 0 \\ 0 & 1 & 0 & 0 & 0 & 0 & 0 & 0 & 0 & 0 & 0 & 0 \\ 0 & 0 & 1 & 0 & 0 & 0 & 0 & 0 & 0 & 0 & 0 & 0 \\ 0 & 0 & 0 & 1 & 0 & 0 & 0 & 0 & 0 & 0 & 0 & 0 \\ 0 & 0 & 0 & 0 & 1 & 0 & 0 & 0 & 0 & 0 & 0 & 0 \\ 0 & 0 & 0 & 0 & 0 & 1 & 0 & 0 & 0 & 0 & 0 & 0 \\ 0 & 0 & 0 & 0 & 0 & 0 & 1 & 0 & 0 & 0 & 0 & 0 \\ 0 & 0 & 0 & 0 & 0 & 0 & 0 & 1 & 0 & 0 & 0 & 0 \\ 0 & 0 & 0 & 0 & 0 & 0 & 0 & 0 & 1 & 0 & 0 & 0 \\ 0 & 0 & 0 & 0 & 0 & 0 & 0 & 0 & 0 & 1 & 0 & 0 \\ 0 & 0 & 0 & 0 & 0 & 0 & 0 & 0 & 0 & 0 & 0 & 1 \end{bmatrix}$$

The observation variance, $V_t$, is a 1×1 matrix that may be initialized when the first full time period's usage information is available. For an additive model, $V_t=Y_f$. For a multiplicative model, $$V_t = \frac{1}{Y_f}.$$

In an embodiment where a printing device uses meter reads of impressions printed, $Y_f$ is the first time period's actual estimated monthly copy volume (EMCV). In an embodiment where a printing device identifies the percentage of a consumable remaining or used, $Y_f$ is the first time period's actual usage.

The system variance matrix, $W_t$, is a 12×12 matrix that may be initialized when the first time period's usage or impression count is available:

$$W_t = \begin{bmatrix} W_{1,1} & 0 & 0 & 0 & 0 & 0 & 0 & 0 & 0 & 0 & 0 & 0 \\ 0 & 0 & 0 & 0 & 0 & 0 & 0 & 0 & 0 & 0 & 0 & 0 \\ 0 & 0 & 0 & 0 & 0 & 0 & 0 & 0 & 0 & 0 & 0 & 0 \\ 0 & 0 & 0 & 0 & 0 & 0 & 0 & 0 & 0 & 0 & 0 & 0 \\ 0 & 0 & 0 & 0 & 0 & 0 & 0 & 0 & 0 & 0 & 0 & 0 \\ 0 & 0 & 0 & 0 & 0 & 0 & 0 & 0 & 0 & 0 & 0 & 0 \\ 0 & 0 & 0 & 0 & 0 & 0 & 0 & 0 & 0 & 0 & 0 & 0 \\ 0 & 0 & 0 & 0 & 0 & 0 & 0 & 0 & 0 & 0 & 0 & 0 \\ 0 & 0 & 0 & 0 & 0 & 0 & 0 & 0 & 0 & 0 & 0 & 0 \\ 0 & 0 & 0 & 0 & 0 & 0 & 0 & 0 & 0 & 0 & 0 & 0 \\ 0 & 0 & 0 & 0 & 0 & 0 & 0 & 0 & 0 & 0 & 0 & 0 \\ 0 & 0 & 0 & 0 & 0 & 0 & 0 & 0 & 0 & 0 & 0 & W_{12,12} \end{bmatrix}$$

For an additive model, $W_{1,1}$=Model Factor One*$Y_f$ and $W_{12,12}$=Model Factor Three*$Y_f$; and for a multiplicative model, $$W_{1,1} = \frac{ModelFactorOne}{Y_f}$$

and $$W_{12,12} = \frac{ModelFactorThree}{Y_f},$$

where $W_{1,1}$ may correspond to the variance of the seasonal component and $W_{12,12}$ may correspond to the variance of the trend component for the dynamic linear model.

The system state matrix, $m_t$, is a 1×12 matrix that may be initialized when the first time period's usage or impression count is available:

$$m_0=[0\ 0\ 0\ 0\ 0\ 0\ 0\ 0\ 0\ 0\ 0\ m_{12}].$$

For an additive model, $m_{12}$ is equal to $Y_{fam}$. For a multiplicative model, $m_{12}$ is equal to $\ln(Y_{fam})$ (i.e., the natural logarithm of $Y_{fam}$).). $Y_{fam}$, may correspond to the family average of machines of a similar type, such as printing devices of the same make and model.

The system covariance matrix, $C_0$, is a 12×12 matrix that may be initialized when the first time period's usage or impression count is available:

$$C_0 = \begin{bmatrix} C_1 & 0 & 0 & 0 & 0 & 0 & 0 & 0 & 0 & 0 & 0 & 0 \\ 0 & C_1 & 0 & 0 & 0 & 0 & 0 & 0 & 0 & 0 & 0 & 0 \\ 0 & 0 & C_1 & 0 & 0 & 0 & 0 & 0 & 0 & 0 & 0 & 0 \\ 0 & 0 & 0 & C_1 & 0 & 0 & 0 & 0 & 0 & 0 & 0 & 0 \\ 0 & 0 & 0 & 0 & C_1 & 0 & 0 & 0 & 0 & 0 & 0 & 0 \\ 0 & 0 & 0 & 0 & 0 & C_1 & 0 & 0 & 0 & 0 & 0 & 0 \\ 0 & 0 & 0 & 0 & 0 & 0 & C_1 & 0 & 0 & 0 & 0 & 0 \\ 0 & 0 & 0 & 0 & 0 & 0 & 0 & C_1 & 0 & 0 & 0 & 0 \\ 0 & 0 & 0 & 0 & 0 & 0 & 0 & 0 & C_1 & 0 & 0 & 0 \\ 0 & 0 & 0 & 0 & 0 & 0 & 0 & 0 & 0 & C_1 & 0 & 0 \\ 0 & 0 & 0 & 0 & 0 & 0 & 0 & 0 & 0 & 0 & C_1 & 0 \\ 0 & 0 & 0 & 0 & 0 & 0 & 0 & 0 & 0 & 0 & 0 & C_2 \end{bmatrix}$$

For an additive model, $C_1$=Model Factor Two*$Y_f$ and $C_2=10^7*D_{fam}$, where $D_{fam}$, is the default EMCV or supply usage for a particular machine type corresponding to the machine being considered. For a multiplicative model, $$C_1 = \frac{ModelFactorTwo}{Y_f}$$

and $$C_2 = \frac{10^7}{D_{fam}}.$$

$C_1$ corresponds to a seasonal variation and $C_2$ corresponds to a trend or periodic variation.

Exemplary parameters for a set of dynamic linear models are disclosed in Table 1 below.

TABLE 1

| Model # | Type | Model Factor One | Model Factor Two | Model Factor Three |
|---|---|---|---|---|
| 1 | Additive | 1E−01 | 1E+04 | 1E+03 |
| 2 | Additive | 1E+00 | 1E+04 | 1E+00 |
| 3 | Additive | 1E−01 | 1E−01 | 1E+05 |
| 4 | Additive | 1E−01 | 1E−01 | 1E−01 |
| 5 | Additive | 1E+03 | 1E−01 | 1E+05 |
| 6 | Additive | 1E−01 | 1E+03 | 1E+05 |
| 7 | Additive | 1E+03 | 1E+03 | 1E+05 |
| 8 | Additive | 1E+00 | 1E+00 | 1E+01 |
| 9 | Additive | 1E+02 | 1E+04 | 1E+03 |
| 10 | Additive | 1E−01 | 1E+01 | 1E+00 |
| 11 | Multiplicative | 1E+00 | 1E−01 | 1E+02 |
| 12 | Multiplicative | 1E−01 | 1E+00 | 1E−01 |
| 13 | Multiplicative | 1E+03 | 1E−01 | 1E+05 |
| 14 | Multiplicative | 1E−01 | 1E+05 | 1E+03 |
| 15 | Multiplicative | 1E+03 | 1E+04 | 1E+05 |
| 16 | Multiplicative | 1E+04 | 1E−01 | 1E+05 |
| 17 | Multiplicative | 1E−01 | 1E−01 | 1E−01 |
| 18 | Multiplicative | 1E+00 | 1E+02 | 1E+02 |
| 19 | Multiplicative | 1E+04 | 1E+05 | 1E+05 |
| 20 | Multiplicative | 1E−01 | 1E−01 | 1E+00 |
| 21 | Multiplicative | 1E+04 | 1E+03 | 1E+05 |
| 22 | Multiplicative | 1E+04 | 1E+05 | 1E−01 |
| 23 | Multiplicative | 1E−01 | 1E+03 | 1E+04 |
| 24 | Multiplicative | 1E+00 | 1E+04 | 1E+00 |
| 25 | Multiplicative | 1E−01 | 1E+03 | 1E+04 |
| 26 | Multiplicative | 1E+02 | 1E+03 | 1E+04 |
| 27 | Multiplicative | 1E−01 | 1E−01 | 1E+05 |
| 28 | Multiplicative | 1E+02 | 1E+05 | 1E+03 |
| 29 | Multiplicative | 1E−01 | 1E+05 | 1E+05 |
| 30 | Multiplicative | 1E+02 | 1E−01 | 1E+00 |

Referring back to FIG. 1, a final consumption forecast for a machine may be determined 115 based on the plurality of model consumption forecasts determined for the machine. In an embodiment, the final consumption forecast may be determined 115 by determining an average forecast of the model consumption forecasts for the plurality of dynamic linear models. In an embodiment, the final consumption forecast may be determined 115 by determining a median forecast of the model consumption forecasts for the plurality of dynamic linear models. In an embodiment, the final consumption forecast may be determined 115 by determining an average forecast of a subset of the model consumption forecasts for the plurality of dynamic linear models. For example, the final consumption forecast may be determined 115 based on a subset of model consumption forecasts that excludes the 5 highest and 5 lowest projections.

In an embodiment, the final consumption forecast may be determined 115 by determining a weight for each of the plurality of dynamic linear models. The weight for each dynamic linear model may be a dynamically adjustable number that is determined based on the accuracy of the particular model with respect to the consumption time series data for the machine over a plurality of trailing time periods. In other words, each model may be compared to prior consumption time series data to determine whether the model approximates the consumption time series closely or not. Based on the closeness of the model to the prior consumption time series data, the weight for the model may be dynamically adjusted. Other methods of determining 115 the final consumption forecast may also be performed within the scope of this disclosure.

An amount of the consumable may be provided 120 for the machine based on the final consumption forecast. For example, an order may be placed for the consumable based on the final consumption forecast. In an embodiment, the order may be placed automatically. The order may be filled by providing 120 the consumable to an operator of the machine.

In an embodiment, providing 120 an amount of the consumable may include determining a safety stock value. The safety stock value may be summed with the final consumption forecast in order to determine an amount of the consumable to be provided 120 to the operator of the machine. In an embodiment, the safety stock value may be determined based on a variance in the consumption time series data for the consumable for the machine.

For example, a safety stock value may be determined based on a customer stocking requirement, such as 30 days stock with P=95% confidence. Using the customer stocking requirement, the Bayesian framework allows calculation of the stocking level to be performed. Because forecasts are conditional distributions, a forecast of mean m and variance V may be defined as f(t)=N(m,V). Using this function, a stocking level L implies that the customer will be in-stock with a probability determined by the following equation:

$$P = 0.5 * \left(1 + \mathrm{erf}\left(\frac{L-m}{V\sqrt{2}}\right)\right),$$

where erf is the error function:

$$\mathrm{erf}(x) = \frac{2}{\sqrt{\pi}} \int_0^x e^{-t^2}\, dt.$$

Solving for the stocking level L in terms of P, m, and V yields: $L=m+V\sqrt{2}*\mathrm{erf}^{-1}(2P-1)$. As such, this will allow inventory to be provided where it is most needed. Customers having greater variances may receive more safety stock than customers with smaller variances.

In an embodiment, the dynamic linear models may incorporate trend, periodicity, regression and variance components. In an embodiment, characteristics of members of a similar subpopulation may be considered for each member. A plurality of models may be selected by identifying clusters of customer behavior. The models may be combined into a single aggregate forecast (i.e., the final consumption forecast).

In an embodiment, an expected volume for a new machine may be determined based upon recent behavior for similar machines if such data is available. Moreover, the expected volume may be determined and/or modified based on business expectations. The initial prediction may be modified as additional information becomes available.

Figure 2:
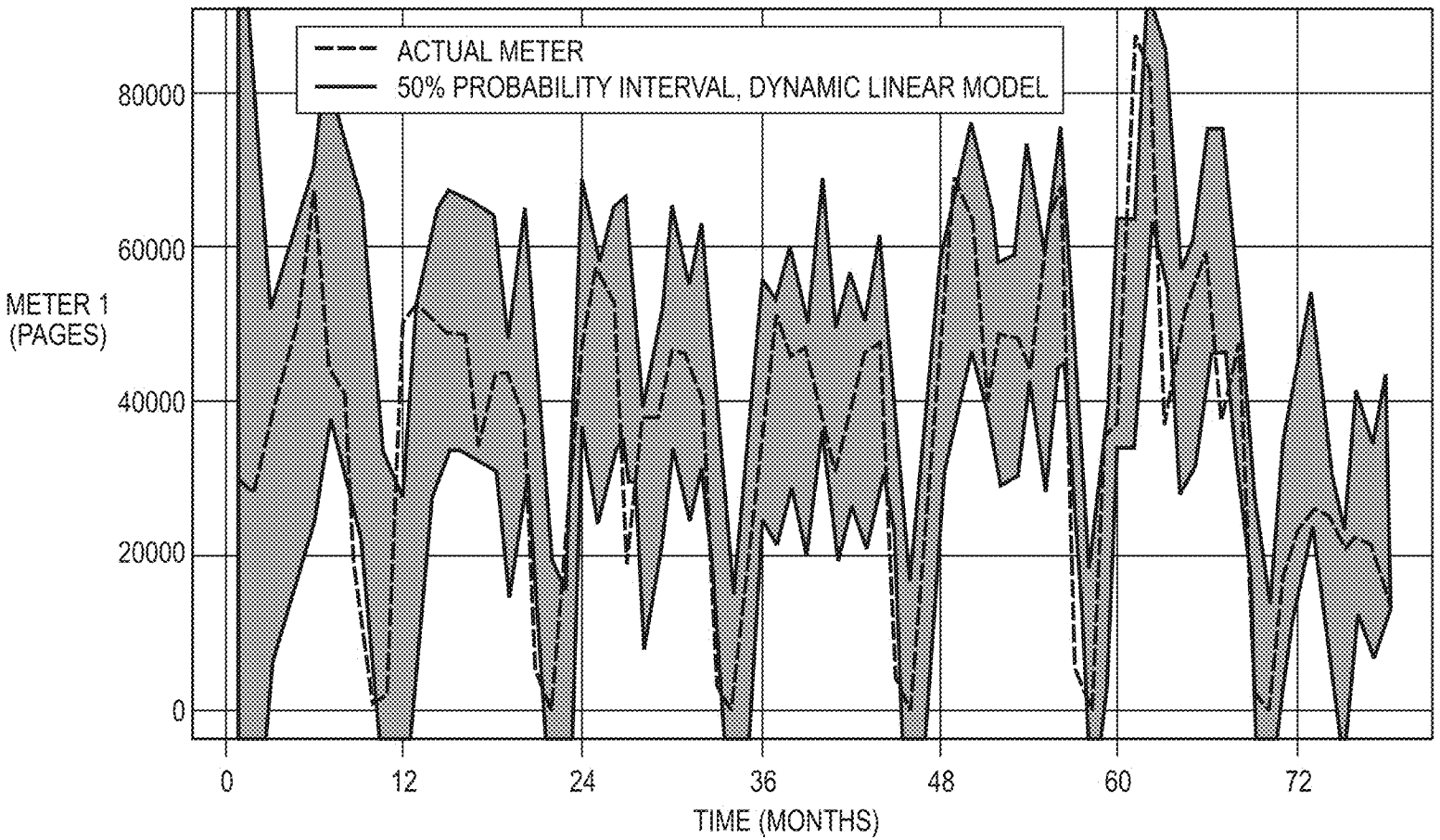
FIG. 2 depicts a graph of illustrative consumption time series data and forecast bands according to an embodiment.

FIG. 2 depicts a graph of illustrative consumption time series data and forecast bands according to an embodiment. As shown in FIG. 2, the line 205 represents the number of monthly impressions for a particular machine and the shaded area 210 represents the one-month-ahead forecasts for the machine as determined according to the teachings of this disclosure. The shaded area 210 represents a 50% probability interval for the one-month-ahead forecasts based on the previously supplied data.

Figure 3:
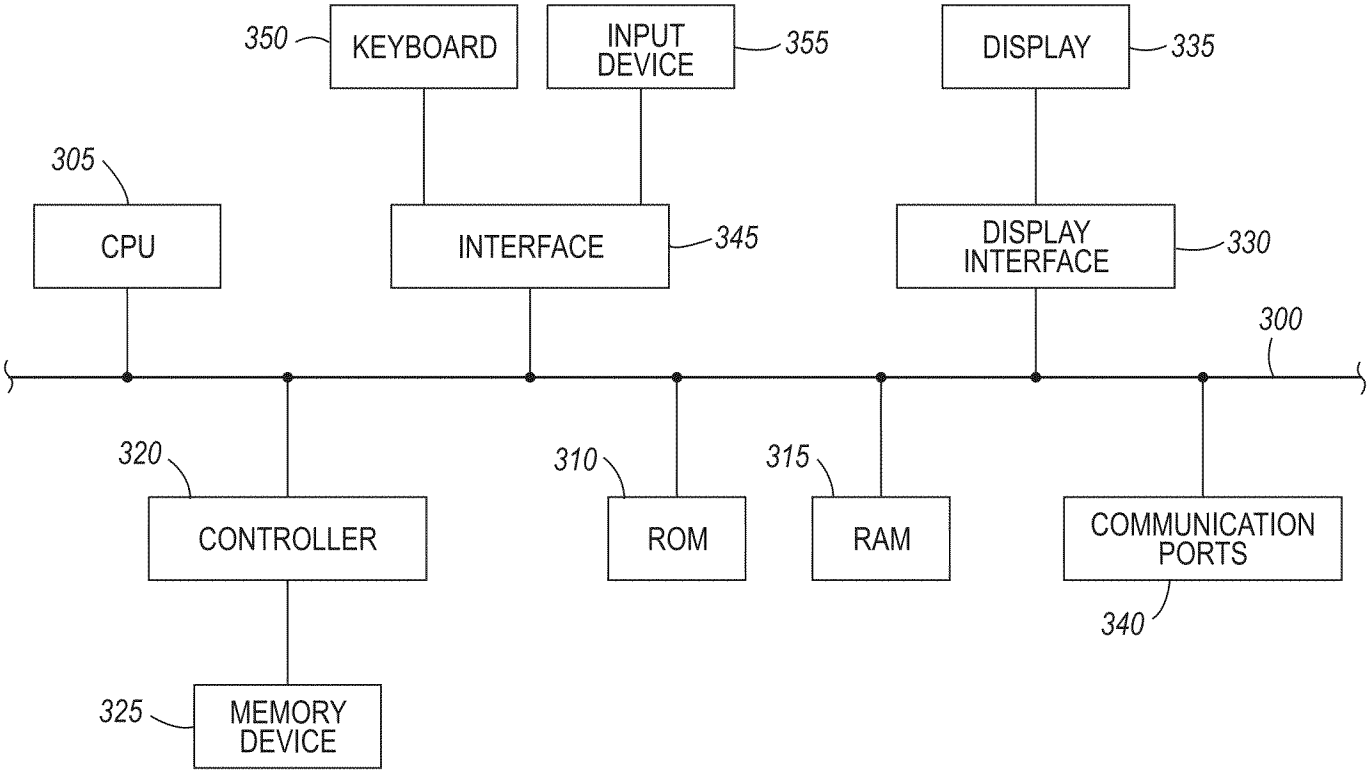
FIG. 3 depicts a block diagram of illustrative internal hardware that may be used to contain or implement program instructions according to an embodiment.

FIG. 3 depicts a block diagram of illustrative internal hardware that may be used to contain or implement program instructions, such as the process steps discussed above in reference to FIG. 2, according to embodiments. A bus 300 serves as the main information highway interconnecting the other illustrated components of the hardware. CPU 305 is the central processing unit of the system, performing calculations and logic operations required to execute a program. CPU 305, alone or in conjunction with one or more of the other elements disclosed in FIG. 3, is an illustrative processing device, computing device or processor as such terms are used within this disclosure. Read only memory (ROM) 310 and random access memory (RAM) 315 constitute illustrative memory devices (i.e., processor-readable non-transitory storage media).

A controller 320 interfaces with one or more optional memory devices 325 to the system bus 300. These memory devices 325 may include, for example, an external or internal DVD drive, a CD ROM drive, a hard drive, flash memory, a USB drive or the like. As indicated previously, these various drives and controllers are optional devices.

Program instructions, software or interactive modules for providing the interface and performing any querying or analysis associated with one or more data sets may be stored in the ROM 310 and/or the RAM 315. Optionally, the program instructions may be stored on a tangible computer readable medium such as a compact disk, a digital disk, flash memory, a memory card, a USB drive, an optical disc storage medium, such as a Blu-Ray™ disc, and/or other non-transitory storage media.

An optional display interface 330 may permit information from the bus 300 to be displayed on the display 335 in audio, visual, graphic or alphanumeric format. Communication with external devices, such as a print device, may occur using various communication ports 340. An illustrative communication port 340 may be attached to a communications network, such as the Internet or an intranet.

The hardware may also include an interface 345 which allows for receipt of data from input devices such as a keyboard 350 or other input device 355 such as a mouse, a joystick, a touch screen, a remote control, a pointing device, a video input device and/or an audio input device.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

What is claimed is:

1. A system for forecasting consumption of a consumable for a multifunction device, the system comprising:

a processor;

a processor-readable non-transitory storage medium in communication with the processor, wherein the processor-readable storage medium contains one or more programming instructions that, when executed, cause the processor to:

compute consumption time series data for a consumable for a plurality of multifunction devices using an amount of the consumable consumed by each of the plurality of multifunction devices, measured using one or more of the following:

a print impression meter associated with each of the plurality of multifunction devices, or a toner usage meter associated with each of the plurality of multifunction devices, wherein the consumption time series data for each multifunction device comprises, for each of a plurality of time periods, the amount of the consumable consumed by the multifunction device during the time period, store the consumption time series data, and for at least one multifunction device of the plurality of multifunction devices:

select a plurality of dynamic linear models each of which has parameters that vary in time based on customer behavior;

for each selected dynamic linear model, determine a model consumption forecast for the multifunction device based on the consumption time series data for the consumable for the multifunction device and the dynamic linear model, determine a final consumption forecast based on each determined model consumption forecast, and determine an amount of the consumable for the multifunction device, to be provided to an operator of the multifunction device, based on the final consumption forecast.

2. The system of claim 1, wherein the consumption time series data comprises print volume usage based on one or more of print impression meter reads and toner usage.

3. The system of claim 1, wherein the one or more programming instructions that, when executed, cause the processor to compute consumption time series data comprise one or more programming instructions that, when executed, cause the processor to compute consumption time series data for a consumable for a plurality of multifunction devices having a similar device type.

4. The system of claim 1, wherein the one or more programming instructions that, when executed, cause the processor to determine a final consumption forecast comprise instructions to determine an average forecast of the model consumption forecasts for the plurality of dynamic linear models.

5. The system of claim 1, wherein the one or more programming instructions that, when executed, cause the processor to determine a final consumption forecast comprise instructions to determine a median forecast of the model consumption forecasts for the plurality of dynamic linear models.

6. The system of claim 1, wherein the one or more programming instructions that, when executed, cause the processor to determine a final consumption forecast comprise instructions to determine an average forecast of a subset of the model consumption forecasts for the plurality of dynamic linear models.

7. The system of claim 1, wherein the one or more programming instructions that, when executed, cause the processor to determine a final consumption forecast comprise instructions to determine a weight for each of the plurality of dynamic linear models, wherein the weight for each dynamic linear model comprises a dynamically adjustable number determined based on the accuracy of the particular model with respect to the consumption time series data for the multifunction device over a plurality of trailing time periods.

8. The system of claim 1, wherein each of the dynamic linear models comprises a Bayesian model.

9. The system of claim 1, wherein the one or more programming instructions that, when executed, cause the processor to determine an amount of the consumable comprise instructions to:

determine a safety stock value; and determine an amount of the consumable equal to a sum of the final consumption forecast and the safety stock value, to be provided to an operator of the multifunction device.

10. The system of claim 9, wherein the one or more programming instructions that, when executed, cause the processor to determine the safety stock value comprise instructions to determine the safety stock value based on a variance in the consumption time series data for the consumable for the multifunction device.

11. A method of forecasting consumption of a consumable for a multifunction device, the method comprising:

computing, by a computing device, consumption time series data for a consumable for a plurality of multifunction devices using an amount of the consumable consumed by each of the plurality of multifunction devices, measured using one or more of the following:

a print impression meter associated with each of the plurality of multifunction devices, or a toner usage meter associated with each of the plurality of multifunction devices, wherein the consumption time series data for each multifunction device comprises, for each of a plurality of time periods, the amount of the consumable consumed by the multifunction device during the time period;

storing the consumption time series data; and for at least one multifunction device of the plurality of multifunction devices:

selecting a plurality of dynamic linear models each of which has parameters that vary in time based on customer behavior, for each selected dynamic linear model, determining, by the computing device, a model consumption forecast for the multifunction device based on the consumption time series data for the consumable for the multifunction device and the dynamic linear model, determining, by the computing device, a final consumption forecast based on each determined model consumption forecast, and providing an amount of the consumable for the multifunction device, to be provided to an operator of the multifunction device, based on the final consumption forecast.

12. The method of claim 11, wherein the consumption time series data comprises print volume usage based on one or more of print impression meter reads and toner usage.

13. The method of claim 11, wherein computing consumption time series data for a consumable comprises receiving consumption time series data for the consumable for a plurality of multifunction devices having a similar device type.

14. The method of claim 11, wherein determining a final consumption forecast comprises determining an average forecast of the model consumption forecasts for the plurality of dynamic linear models.

15. The method of claim 11, wherein determining a final consumption forecast comprises determining a median forecast of the model consumption forecasts for the plurality of dynamic linear models.

16. The method of claim 11, wherein determining a final consumption forecast comprises determining an average forecast of a subset of the model consumption forecasts for the plurality of dynamic linear models.

17. The method of claim 11, wherein determining a final consumption forecast comprises determining a weight for each of the plurality of dynamic linear models, wherein the weight for each dynamic linear model comprises a dynamically adjustable number determined based on the accuracy of the particular model with respect to the consumption time series data for the multifunction device over a plurality of trailing time periods.

18. The method of claim 11, wherein each of the dynamic linear models comprises a Bayesian model.

19. The method of claim 11, wherein providing an amount of the consumable comprises:

determining a safety stock value; and determining an amount equal to a sum of the final consumption forecast and the safety stock value.

20. The method of claim 19, wherein determining the safety stock value comprises determining the safety stock value based on a variance in the consumption time series data for the consumable for the multifunction device.

21. The method of claim 11, wherein determining a model consumption forecast for the multifunction device is further based on consumption time series data for the consumable for one or more multifunction devices in the plurality of multifunction devices other than the multifunction device.

22. The system of claim 1, wherein each of the dynamic linear models may comprise one or more trend components.

23. The method of claim 11, wherein selecting, by the computing device, the plurality of dynamic linear models comprises selecting the plurality of dynamic linear models, wherein each of the dynamic linear models may comprise one or more trend components.

* * * * *